United States Patent [19]

Knüppel et al.

[11] 4,062,657

[45] Dec. 13, 1977

[54] METHOD AND APPARATUS FOR DESULPHURIZING IN THE GASIFICATION OF COAL

[75] Inventors: Helmut Knüppel; Karl Brotzmann; Hans-Georg Fassbinder, all of Sulzbach-Rosenberg, Germany

[73] Assignee: Eisenwerk-Gesellschaft Maximilianshutte mbH, Sulzbach-Rosenberg, Germany

[21] Appl. No.: 684,330

[22] Filed: May 7, 1976

[30] Foreign Application Priority Data

May 9, 1975 Germany ..... 2520584

[51] Int. Cl.[2] ..... C10J 3/20

[52] U.S. Cl. ..... 48/77; 48/92; 48/206; 48/210; 75/55; 252/373; 266/212

[58] Field of Search ..... 48/92, 197 R, 202, 203, 48/206, 209, 210, 77; 423/210.5; 75/34, 42, 55; 266/212, 216, 210, 215, 227; 252/373; 110/7 R, 1 H

[56] References Cited

U.S. PATENT DOCUMENTS

| | | | |
|---|---|---|---|
| 2,193,593 | 3/1940 | Heuer | 75/55 |
| 2,647,045 | 7/1953 | Rummel | 48/206 |
| 3,504,899 | 4/1970 | Breuer et al. | 266/239 |
| 3,510,116 | 5/1970 | Harvill et al. | 266/239 |
| 3,533,739 | 10/1970 | Pelczarski et al. | 48/92 |
| 3,701,519 | 10/1972 | Vayssiere et al. | 266/215 |
| 3,787,193 | 1/1974 | Seglin et al. | 48/202 |

FOREIGN PATENT DOCUMENTS

| | | | |
|---|---|---|---|
| 2,443,740 | 3/1975 | Germany | 48/206 |

OTHER PUBLICATIONS

Clean Fuels from Coal Symposium Papers, Inst. of Gas Technology, Sept. 1973, "Fuel Gas From Molten Iron Coal Gasification" pp. 285–300, La Rosa et al.

*Primary Examiner*—Robert L. Lindsay, Jr.
*Assistant Examiner*—Peter F. Kratz
*Attorney, Agent, or Firm*—Lawrence I. Field

[57] ABSTRACT

This application describes a process and apparatus for gasifying sulphur bearing coal in a molten iron bath which is covered with a sulphur absorbing slag. In order to make the process practical, the hot liquid slag is transferred to a second vessel in which it is desulfurized by contact with an oxygen containing gas, and then returned as hot liquid slag to the iron bath for reuse.

8 Claims, 2 Drawing Figures

METHOD AND APPARATUS FOR DESULPHURIZING IN THE GASIFICATION OF COAL

The invention relates to a method of removing a significant proportion of the sulphur from the coal in the gasification of coal in an iron bath reaction vessel, using a sulphur-absorbent slag and apparatus for making use of the method.

In the use of coal as an energy carrier the sulphur content of the coal has a damaging effect to an increasing extent. Many coal materials cannot be used, on account of their sulphur content as with the present day state of the art there is no operationally reliable and thereby economically workable method of de-sulphurising coal.

The unwanted effects of the sulphur and of the resulting reaction products are, amongst other things, increased corrosion of the components of the installation which come into contact with the sulphur and in particular with its gaseous reaction products. In chemical processes the effects are, amongst other things, the interference with and destruction of catalysts. The deciding drawback in the use of sulphur-containing coal as an energy carrier lies in the pollution of the environment by the resulting sulphur-containing waste gases.

In the present state of the art there are numerous chemical processes for freeing the gaseous products of combustion of the coal from their sulphur content. Hitherto none of these methods has succeeded as they either did not allow any reliable de-sulphurising action over long periods of time or they were simply not economical to operate.

A process described in U.S. Pat. Nos. 3,526,473 and 3,533,739 is based on adding finely divided coal continuously to a bath of molten iron and producing from it a largely sulphur-free combustible gas, mainly comprising carbon monoxide and hydrogen. The finely divided coal is supplied to the molten iron below the surface of the bath through a water-cooled lance or similar device. Simultaneously oxygen and steam are introduced into the bath through a second lance device. Lime, limestone or dolomite is present on the surface of the bath to produce a slag which has a de-sulphurising action. Under favourable processing conditions the bath produces a gas having an approximate composition of about 70 to 80% carbon monoxide and about 15 to 25% hydrogen. The sulphur present in the coal is picked up by the basic slag, especially lime-rich slag, present on the bath.

This process cannot operate on a large scale as the problems resulting from the handling of the slag prevented this method being operated economically.

For continuously de-sulphurising the bath of molten iron, to which sulphur is continuously being added by the coal that is introduced, substantial quantities of slag are necessary and must be continuously withdrawn in order to achieve continuous removal of the sulphur. So as to obtain a high concentration of sulphur in the slag, the slag must be adjusted to have a high basicity ($CaO:SiO_2$) in the slag. The sulphur saturation solubility with a slag basicity of around 4 is about 5% sulphur. This means for example, for a coal containing 2% sulphur, the slag required is 400 kilograms per ton of coal. The disposal or employment of this quantity of slag itself presents a serious problem, quite apart from the adverse effect on the economy of such a method. In particular it also upsets the heat balance of the process.

In order to offset this drawback at least to some extent, it has been proposed to withdraw the sulphur-rich slag from the reaction vessel on a continuous basis and de-sulphurise this slag by treatment with steam. The slag treated in this way can then be returned to the process again in a powdered form and introduced into the bath of molton iron.

It is true, however, that the heat losses involved in re-using the treated slag, which now also contains the ash content from the coal, are so substantial that the process is only capable of being carried out with high quality, high energy grades of coal and with the use of pure oxygen as the treatment medium. The idea of using grades of coal having low heat value and then adding external energy to the bath, for example by electric arc heating, has been found in practice to be incapable of fulfillment. This is apparently attributable to the high reaction density in the combination of coal and oxygen in the bath of iron, which keeps the supply of additional energy within narrow limits.

The aim of the present inventions lies in providing a method which, whilst avoiding the drawbacks described, makes it possible to gasify, in an iron bath reaction vessel, grades of coal having very widely differing heat values and sulphur contents, in a reliable and economical manner, and to remove a substantial proportion of the sulphur from the coal.

This problem is solved according to the invention, in the process for removing a substantial proportion of the sulphur in the coal fed into an iron bath reaction vessel in the gasification of coal by means of a sulphur-absorbing slag, in that the liquid sulphur-rich slag is transferred in a liquid condition from the main molten iron reaction vessel to a reaction vessel where it is de-sulphurised by the introduction of oxygen or oxygen-containing media with or without the addition of inert gas, and is then returned to the main reaction vessel in a liquid condition.

The de-sulphurisation in a reaction vessel which is completely separate in its gas space from the main iron bath reaction vessel, preferably takes place by the introduction of oxygen below the surface of the molten slag. Advantageously the oxygen is fed through the floor and/or in the low region of the side wall of the vessel in order to keep the path of flow within the slag large and thereby achieve intensive de-sulphurisation. It has been found that the removal of the sulphur from the slag is promoted by introducing an inert gas into the slag below its surface level, either mixed with the oxygen or simultaneously but separately from the oxygen. The nozzle for introducing oxygen or oxygen-containing media and inert gas can for example by made of two concentric tubes, the oxygen being fed in through the inner tube and the inert gas through the annular space around it.

It is also within the scope of the invention to introduce air into the reaction vessel to de-sulphurise the slag. The air can be cold or pre-heated, according to the heat balance in the process. For example consideration has been given to the addition of a blast furnace gas with and without the addition of cold air.

In carrying out the method according to the invention it has been found advantageous to maintain the temperature in the main reaction vessel and in the auxiliary reaction vessel for de-sulphurising the slag substantially equal. The temperature in the main vessel can be reduced and thereby controlled within wide limits by the addition of materials which react with the absorption of heat, for example steam or powdered limestone. In the de-sulphurising vessel the temperature can be controlled by the oxygen content of the gas mixture, its temperature and its quantity. In practice it has been found preferable, in carrying out the process, to have a temperature in the main reaction vessel and in the slag-desulphurising vessel, of around 1350° to 1450° C. This temperature range is not to be taken as being limiting and it can be exceeded either upwards or downwards by at least 100° C. According to the process parameters, the temperature can be varied and also it is possible for there to be temperature differences between the main vessel and the slag-de-sulphurising vessel.

A further advantage of the process according to the invention lies in keeping the sulphur content of the slag in the main reaction vessel relatively low and thereby employing slags of low basicity. Whereas one would nomally employ basicities ($CaO:SiO_2$) in the range between 1 and 3, this process allows adequate de-sulphurisation even with basicities of, for example, 0.8 and below.

Because of the low basicity of the slag in conjunction with the components of the ash from the coal, which generally contain significant quantities of alkalis, the de-sulphurising slag has a low melting point. This again is an important requirement for the low operating temperatures of the process according to the invention.

Moreover the low basicity of the de-sulphurising slag means that only a small addition of lime is required in order to maintain the desired slag composition despite the continuous addition of the ash from the coal. This is an advantage which favours the heat equations in the process according to the invention.

The composition of the de-sulphurised slag which is returned from the de-sulphurising reaction vessel to the main vessel and of which a predetermined proportion is withdrawn from the circuit during this path, makes it possible to use this withdrawn slag in the production of cement.

In the normal performance of the process according to the invention the sulphur contents of the de-sulphurising slags withdrawn from the main reaction vessel are well below their sulphur saturation level. For example one can operate with a sulphur content in the slag of below 1%. Whilst the de-sulphurising slags from the iron bath reaction vessel may have sulphur contents of 1 to 3%, they are however preferably de-sulphurised in the other vessel to sulphur contents between 0.5 and 1%.

The low sulphur contents in the de-sulphurising slags obviously also allow extremely low sulphur contents in the gas produced in the iron bath reaction vessel. Where extremely low sulphur contents are required in the production of gas in the iron bath, the sulphur content in the de-sulphurised slag in the bath can for example be kept at around 10% of its saturation solubility. However it is true that the de-sulphurisation of these slags is less favourable on the heat balance of the overall process as the proportion of inert gas in the de-sulphurisation process must be increased significantly.

The invention is further explained in the following in conjunction with the drawings, in which.

Figure 1:
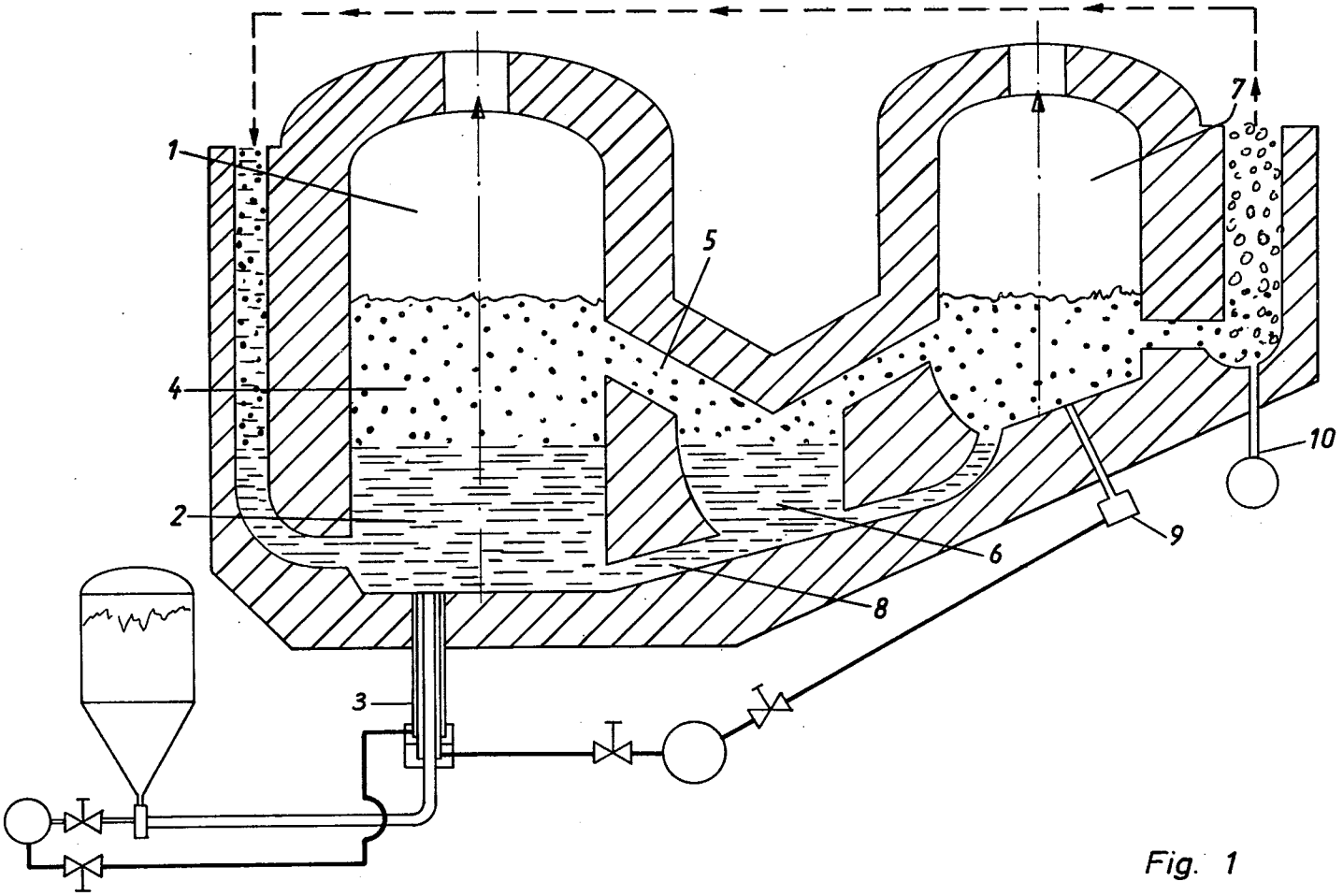
FIG. 1 is a vertical section through the apparatus of the invention.

In a molten iron bath reaction vessel 1 which is like a converter and which is partially filled with a carbon-containing iron bath 2, coal dust, oxygen or oxygen-containg media and lime dust are blown into the bath 2 through nozzles 3. The de-sulphurising slag 4 flows through an outlet passage 5, in which is incorporated a settling chamber 6 to remove droplets of iron, to the reaction vessel 7 for de-sulphurising the slag. The iron which collects from the separated-out droplets flows back to the vessel 1 through a passage 8.

The settling chamber 6 in the slag withdrawal passage 5 is of great significance in giving the opportunity for as complete as possible separation of particles of iron which are carried from the bath of molten iron in the main vessel in the slag and which are chiefly present in the slag in the form of finely divided droplets. It is important that the separation of the iron particles from the slag before the slag reaches the de-sulphurising vessel 7 should be as complete as possible because particles of metal in the slag have an adverse effect on the de-sulphurisation in the vessel 7. Chiefly these metal particles adversely affect the de-sulphurisation of the slag in relation to the added oxygen and thereby make it almost impossible to regulate the de-sulphurisation of the slag. Likewise the temperature in the slag-de-sulphurising vessel 7 cannot be controlled within the desired limits, because of possible addition of heat through combustion of the metal. The size of the settling chamber 6 is selected to achieve an adequate dwell period for the slag in this chamber, i.e. the velocity of flow of the slag must be reduced in the chamber 6 significantly as compared with it velocity in the passage 5. When the coal gasification process in carried out rapidly and there is a consequent high throughout of slag the settling chamber 6 must be made larger than while the gasification is relatively slower. Normally the ratio of the cross-section between the passage 5 and chamber 6 should be maintained at at least 1:10.

Oxygen of oxygen-containing media are introduced into the slag-de-sulphurising vessel 7 through a nozzle 9 mounted in the floor and this produces oxidation of the slag which leads to a substantial reduction in the sulphur solubility and oxidation of the sulphur, which is then removed from the system as sulphur dioxide.

Figure 2:
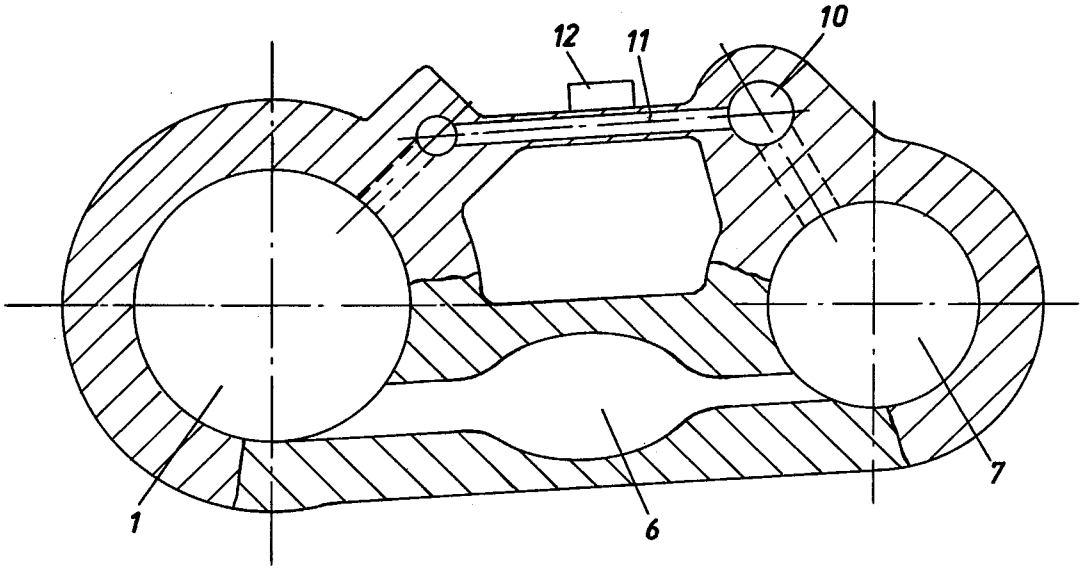
FIG. 2 is a horizontal section through FIG. 1.

By means of a gas lift 10, fed for example with nitrogen, the slag is directed back to the iron bath reaction vessel 1 through a passage 11 shown in FIG. 2.

In a particular version of the gas lift 10 the nozzle 9 required for de-sulphurising the slag is mounted in the floor lining of the vessel 7 in such a way that it fulfils the function of the gas lift and makes a separately provided gas lift 10 unnecessary.

In FIG. 2 there is also seen the overflow 12 provided in the slag return passage 11, by means of which a portion of the slag is continuously withdrawn from the circuit.

The examples of the apparatus according to the invention is to be understood as being a preferred embodiment but by not means limiting. In particular it is entirely within the scope of the invention to make changes in the construction of the apparatus that correspond to the principle of the method according to the invention.

We claim:

1. In a method of gasifying coal in a molten iron bath covered with a liquid, sulphur absorbing slag, wherein sulphur bearing coal is charged with the molten iron bath in a coal gasification vessel and gasified therein, by reaction with an oxygen-containing/gas introduced into said molten iron bath and the sulphur in the coal passes into the sulphur absorbing slag overlying the molten iron bath, the improvements which include:

continuously transferring some of said liquid slag from said gasification vessel to a desulphurization vessel connected thereto via a passage operatively associated with a settling chamber for the collection of any iron droplets entrained in said liquid slag;

separating said iron droplets from said liquid slag in said settling chamber;

desulphurizing said transferred liquid slag by introducing an oxygen containing gas below the surface of said liquid slag after it has been transferred into said desulphurization vessel and while it remains liquid, to diminish the sulphur content of said slag; and then returning almost all of the resulting desulphurized liquid slag to said coal gasification vessel while said slag is still liquid and while it retains a substantial portion of the sensible heat it contained when it was transferred from said coal gasification vessel to said desulphurization vessel, thereby conserving the heat contained in said slag.

2. The method of claim 1 in which said oxygen containing gas introduced into the desulfurization vessel is a mixture of oxygen and an inert gas.

3. The method of claim 1 in which said oxygen containing gas introduced into the desulfurization vessel is air.

4. The method according to claim 1 wherein the temperature of the liquid slag lies between about 1350° C and about 1450° C.

5. The method of claim 1 wherein the sulphur content of the slag in said coal gasification vessel is between about 1 to about 3% by weight of the slag.

6. The method of claim 5 wherein the sulphur content is about 1%.

7. An apparatus for gasifying sulphur bearing coal including a coal gasification vessel containing a molten iron bath and provided with tuyere means for introducing fluids into said bath in said coal gasification vessel and a desulphurization vessel containing a molten bath of sulphur rich slag and provided with means to inject oxygen containing gas into said slag; and passage means in the walls of said vessels for placing said coal gasification vessel and its contents in communication with said desulphurization vessel and its contents, said passage means including a first passage in the wall of said gasification vessel blow the top of said slag for withdrawing liquid slag from said gasification vessel and a second passage in the wall of said gasification vessel for returning said liquid slag to said gasification vessel after it has been treated in said desulphurization vessel;

means defining a settling chamber in the first said passage for separating out iron droplets from the sulphur-rich slag as it is transferred from said gasification vessel to said desulphurization vessel and return passage means communicating with said settling chamber and said coal gasification vessel for returning the separated iron to the gasification vessel; and means defining an outlet in said desulphurization vessel for withdrawing of a portion of the liquid slag after it has been desulphurized in said desulphurization vessel.

8. Apparatus according to claim 7 including in addition a gas lift means (10) in communication with said outlet in said desulphurization vessel and with said second passage in the wall of the gasification vessel whereby the desulphurized slag is returned from the slag desulphurizing vessel (7) to said second passage (11).

* * * * *